United States Patent [19]

Getz

[11] Patent Number: 4,597,538

[45] Date of Patent: Jul. 1, 1986

[54] ASPHALT COMMINUTING APPARATUS

[76] Inventor: Roland A. Getz, P.O. Box 6249, Phoenix, Ariz. 85005

[21] Appl. No.: 610,776

[22] Filed: May 16, 1984

[51] Int. Cl.[4] ..... B02C 13/28

[52] U.S. Cl. ..... 241/86.1; 241/88.4; 241/195; 241/294

[58] Field of Search ..... 241/294, 189 R, 191, 241/192, 195, 86.1, 88.2, 88.3, 88.4, 73, 293, 295

[56] References Cited

U.S. PATENT DOCUMENTS 3,150,837 9/1964 Hanse ..... 241/189 R
3,608,841 9/1971 Wageneder ..... 241/189 R

FOREIGN PATENT DOCUMENTS 1454633 11/1976 United Kingdom ..... 241/191

*Primary Examiner*—Mark Rosenbaum

*Attorney, Agent, or Firm*—William R. Laney

[57] ABSTRACT

A comminuting apparatus which includes a housing containing a drum rotatable about a horizontal axis, a first crushing and screening grate pivotally suspended in the housing, and having a lower end adjustably movable toward the drum to form with the drum a selectively widenable throat, and a second arcuate fine grinding and screening grate pivotally mounted in the housing, and forming with the drum an adjustably dimensioned constricting throat. The drum carries at its outer periphery, a plurality of circumferentially spaced, axially extending rows of detachably mounted hammer elements. Each hammer element in each of the axial rows is received in an undercut, trapezoidally-shaped slot in an elongated hammer retainer bar. Each of the hammer bars is retained in its respective undercut slot by a plurality of wedge blocks.

24 Claims, 8 Drawing Figures

ASPHALT COMMINUTING APPARATUS

FIELD OF THE INVENTION

This invention relates to crushing and comminuting devices, and more particularly to an apparatus for crushing and comminuting chunks of asphalt for the purpose of reconstituting and recycling the asphalt after it has been removed from an old road bed.

BRIEF DESCRIPTION OF THE PRIOR ART

Many devices and machines have been developed for comminuting chunks and masses of frangible materials by the use of rotating drums which carry hammers at the outer periphery thereof. Machines of this type include hammer mills and various types of pulverizing systems.

In some of the comminuting machines heretofore utilized, and in many which have been patented, the rotating drum with its peripheral hammers acts in cooperation with one or more grates to provide constricted throats or nips. The constricted throats or nips function as a confining and crushing situs in which larger particles, previously partially reduced by impact with the rotor or drum hammers, undergo further crushing and grinding in passing through the constriction.

Examples of some of the types of comminuting machines which have previously been proposed and utilized for the described purpose, and which have been patented are described in U.S. Pat. No. 2,862,669 to Rollins, U.S. Pat. No. 2,767,923 to Hanse et al, U.S. Pat. No. 3,146,959 to Putnam, Jr., U.S. Pat. No. 646,249 to Williams, U.S. Pat. No. 3,813,045 to Von Greiffenstern, U.S. Pat. No. 3,934,826 to Graveman, U.S. Pat. No. 3,237,873 to Raski, U.S. Pat. No. 1,035,313 to Buchanan, U.S. Pat. No. 1,872,233 to Borton, U.S. Pat. No. Re. 17,334 to Liggett and U.S. Pat. No. 759,856 to Borton.

In general, each of the cited patents is directed to a crushing or comminuting or pulverizing apparatus which includes an enclosing housing in which is mounted some type of rotating impact member, such as a drum or rotor carrying hammers or impact elements at its outer periphery. The material which is to be subdivided is loaded into the housing and gravitates on to the periphery of the drum. There it is impacted by the hammers as the drum is rotated. This acheives a first stage of comminution or subdivision of the charged material.

As the drum carrying peripheral hammers continues to rotate, several of the patented structures provide for a wedging or jamming action to occur between the hammers at the periphery of the drum and one or more grates or screens. Where a plurality of grates are used, the process of particle subdivision is intensified as further rotation of the drum occurs so that, toward the bottom of the housing, the finest subdivision occurs and screening occurs at that point through a grate or screen defining relatively small openings.

One of the foregoing patents of this general type is Borton U.S. Pat. No. 759,856. This patent discloses a first upper grate having vertically extending bars. The generally vertically extending first grate and its bars extend at an angle to a tangent to the rotational path swept out by hammers carried at the periphery of a rotating drum. The grate thus forms with the hammers a reducing section or nip between the hammer tips and the grate. The angle which is formed between the upper grate and a tangent to the periphery of the drum can be varied by changing the inclination of the upper grate to the vertical, and thus increasing or decreasing the width of the constriction formed between the lower portion of the upper grate and the hammer bars. The Borton structure further includes a lower second grate, also having bars, and disposed within the housing beneath the upper grate. This lower grate can also be adjusted so as to change or vary the size of the nip between the leading edge of the grate and the drum hammers.

In the Borton patent, the material to be crushed is fed into the housing so that it is first contacted by the rotating hammers at a location immediately adjacent the upper grate. There is therefore relatively little opportunity for impact to occur between the rotating hammers and the material to be crushed prior to the time that the material is jammed into the nip between the lower end of the upper grate and the rotating hammers.

U.S. Pat. No. Re. 17,334 to Liggett also discloses an apparatus of the type having a rotating drum carrying peripheral hammers and mounted within a housing for rotation about a horizontal axis. The Liggett apparatus provides a more extended opportunity for the material to be comminuted to be impacted by the hammers before the material is driven into certain plates provides within the housing in a position to form a throat between these plates and the rotating hammers. A narrow gap exists between an abutment carried on one of the uppermost of the plates, and the periphery of the hammers carried on the rotor, and the upper plates can be moved inwardly toward the drum to adjust the clearance between these plates and the rotating drum. The Liggett apparatus also includes a lower grate which has grate bars which extend transversely and parallel to the axis of the rotating drum. Particles of the pulverized material are discharged between the grate bars of the lower grate, and the size of such particles depends upon the adjusted width of the throat which is formed between the lower grate and the hammers of the rotating drum.

U.S. Pat. No. 1,872,233 to Borton is directed to a hammer crusher which has a rotatable drum mounted within a housing having an open throat or material entrance at the top. The drum carries radially extending hammers at its periphery. These hammers cooperate with an upper grate mechanism which is pivotally mounted within the housing so that its lower end can be advanced toward, or retracted away from, the path of the hammers. A second or lower grate mechanism also acts in cooperation with the peripheral hammers and is also adjustable toward and away from the path of the hammers by a linkage mechanism.

When the material to be crushed is poured into the housing through the open top, it is impacted by the rotating hammers, and is then moved into the restricted space formed between the hammer tips and the upper grate meechanism which carries a plurality of removably mounted grate bars. Some of the material is forced between these bars and falls to a collection point at a location below the upper grate. Finer material is forced to pass between the openings between the bars of the lower grate. The hammers which are mounted at the periphery of the drum are pivotally attached thereto, and are therefore free swinging. They are extended radially outwardly from the drum by centrifugal force as the drum is rotated.

An impact hammer mill is disclosed in Putnam, Jr. U.S. Pat. No. 3,146,959 and includes a housing contained in the lower portion thereof, a rotating drum carrying peripheral hammers. The periphery of the drum is formed on eccentric arcs of rotation to provide maximum impacting contact of the hammers with the material to be comminuted in the hammer mill. The material is fed into the drum through an opening, slides down a slide plate to a point adjacent the drum where it falls into contact with the rapidly rotating hammers. After impact by the hammers and rebound from the top of the housing, the charged material is impacted by the hammers a second time, and is propelled or driven through the bars of an upper grate located at one side of the upper portion of the housing. Material too large to pass through the bars of the upper grate falls onto a lower grate and is trapped between this grate and the bars of the hammer by entry of the material into a constricted throat formed between the lower grate and the path of the rotating hammers. The lower grate can be pivoted about a pivotal axis at its upper side so that the bottom portion of the grate can be moved closer to or further from the rotating drum and its associated hammers. Relatively finer material is, of course, forced through the bars of the lower plate.

Pivotally mounted, radially extending hammers mounted on the periphery of a rotating drum disposed within a housing are also parts of the crusher and pulverizer apparatus which is shown in Buchanan U.S. Pat. No. 1,035,313. There is also included a lower grate having bars which extend transversely and parallel to the rotational axis of the rotor. The lower grate serves to pass fine particles to a retrieval space located in the bottom portion of the housing.

A coal crusher apparatus is illustrated and described in Graveman U.S. Pat. No. 3,934,826. This system includes a rotating drum having breaker rings mounted at the outer periphery of the drum and functioning to crush chunks of coal poured into the upperside of the housing in which the drum is located. Small particles of the fractured coal initially pass through a relatively large opening upper grate. The remaining relatively large coal particles are then trapped between the breaker rings and an arcuate lower grate which is curved so that the space between the grate and the breaker rings gradually decrease in the direction of rotation of the rotor. Relatively smaller particles of coal are forced through the axially extending bars of the lower grate as the drum continues to rotate and the coal particles are crushed between the lower grate and the breaker rings.

Since one of the important aspects of the present invention is the manner in which a set of unique hammer assemblies are secured to the periphery of a rotatably mounted drum forming a part of the comminuting apparatus of the invention, that prior art which is known to me and is directed to hammer assemblies of a character generally similar to those used in the present invention will be briefly described.

Various types of hammer mounting systems have been used for mounting the impact hammers on the periphery of a rotating drum or other rotor-type member used for comminuting and crushing in systems of the type hereinbefore described. In Hanse et al U.S. Pat. No. 2,767,923, a plurality of hammers are mounted at the periphery of a rotating rotor with the hammer bars being generally rectangular in shape and extending into radial openings formed in the periphery of the rotor. The hammer bars are held in place by trapezoidally-shaped wedges which are drawn into a wedging engagement with the hammer bars by adjustable bolts which are extended through the wedges and into the body of the rotor.

In Rollins U.S. Pat. No. 2,862,669, elongated hammer bars, which extend the length of a rotary drum utilized in the Rollins apparatus, are used for reducing solid material by impact. The hammer bars have projecting toes which, with the bases of the hammer bars, are positioned within relatively large recesses or troughs formed at the outer periphery of the drum. A bolt is extended through a portion of the periphery of the hammer into retraining contact with each toe of the hammer bar to maintain the hammer bar in position as the rotor is rotated, and the hammer bars impact with the material to be pulverized.

In the coal cutting machine shown in British Pat. No. 22,042, a coal cutting blade or tip projects from the periphery of a rotatable drum and has a root portion which extends into a trapezoidally-shaped recess formed in a lug on the periphery of the drum. The root portion of the cutter tip is wedged against one side of the recess by means of a trapezoidal block which can be forced downwardly into the recess by means of screws which extend radially into the lug carried on the drum.

A patent which is of general interest with respect to the securement of a projection to a generally cylindrically body, such as a drum or rotor, is U.S. Pat. No. 3,340,783 to Edminster. The Edminster patent relates to a compactor drum which has attached to the periphery thereof, one or more compactor lugs. These lugs have an end portion which includes a dovetail groove into which may be positioned the dovetailed tongue portion of a removable cap member comprising two similar cap segments. The cap segments are prevented from moving longitudinally out of their respective dovetailed grooves by means of pins inserted through the lug and the paired cap segments.

The Putnam, Jr. patent, previously discussed in reference to the overall construction of the impact hammer mill there shown, includes a rotor carrying elongated hammer bars which are slid longitudinally into undercut slots formed in the periphery of the rotor. The hammer bars are locked in place by means of toes which enter the undercuts formed radially inwardly from the peripheral surface of the rotor.

BRIEF GENERAL DESCRIPTION OF THE PRESENT INVENTION

The present invention provides a crusher/breaker which has been especially designed for crushing and breaking chunks of asphalt and cold milled asphalt for recycling purposes. In the apparatus of the invention, comminution of asphalt chunks fed to the apparatus is accomplished by both impact and attrition. The size of the product particles can be controlled by adjusting upper and lower grates forming parts of the apparatus so as to move a terminal portion of each of these grates closer to, or away from, the hammers carried on a rotating drum which passes in close proximity to the grates.

Broadly described, the asphalt comminuting apparatus of the invention includes a housing which contains a drum which is mounted in the lower central portion thereof for rotation about a horizontal axis. The drum has a peripheral surface which is formed on a plurality of eccentric surfaces of rotation in cylindrical segments so that the periphery of the housing is radially stepped at at least two locations around its periphery to accommodate axially extending rows of detachably mounted impact hammers. The impact hammers and their detachable mounting means make up hammer assemblies which extend axially along the periphery of the drum at circumferentially spaced locations. The hammers project radially outwardly from the drum at these locations. A first relatively large crushing and screening upper grate is pivotally suspended within the housing for pivotation about a pivotal axis which passes through the upper end of the grate. The lower end of the upper grate is adjustably movable toward and away from the pulverizing drum so as to form a selectively widenable throat or nip with the drum and its peripherally mounted hammers.

Located within the lower portion of the housing is a second arcuate fine grinding and screening grate which is also pivotally mounted in the housing and forms with the drum and its hammers, an adjustably dimensioned constricting throat or nip.

The hammer assemblies carried on the outer periphery of the drum include elongated hammer bars which carry a toe at one side thereof which slides into an undercut recess formed in the periphery of the drum in which the hammer assemblies are mounted. Opposite the toe carried by each of the hammer bars, the hammer bar has a beveled or tapered surface which is cooperatively engaged by a wedge block also fitted within the radially inwardly extending slot formed in the periphery of the drum.

Each of the hammer bars carries a plurality of undercut, generally trapezoidally-shaped slots into which can be placed a plurality of hammers located in axial alignment along the hammer bar and extending parallel, in their collective array, to the axis of rotation of the drum. The wedge blocks employed for locking the hammer bar in place can be tightened into wedging, hammer bar retaining position by means of threaded bolts which can be backed out of threaded receiving bores formed in one side of each of the wedge blocks.

The individual hammers are retained in the hammer bar slots by means of elongated threaded bolts which are countersunk into the respective hammers from one side thereof, and have a threaded shank extending from the opposite side of each hammer through a retention plate or drum abutment portion. Each of these bolts reacts to an adjusting nut located on the opposite side of the retention plate from the respective hammer through which the respective bolt extends. Each protruding bolt shank portion and nut used to retain one of the hammers in position is located in a chordal groove or recess cut into the periphery of the rotating drum.

The described hammer assembly construction permits quick replacement of parts which become worn, abraded or sheared away in the course of use of the apparatus for comminuting asphalt. Each of the several hammers in the hammer assemblies can be individually quickly replaced with a new hammer if the necessity arises. The hammer retaining bar can also be replaced quickly by loosening the wedge blocks which hold the hammer bar locked into the peripheral undercut recess in the rotating drum.

An important object of the present invention is to provide an improved device for comminuting asphalt in an controlled fashion to produce product particles of a selectively variable size.

A further object of the invention is to provide an asphalt comminuting apparatus which uses both impact and attrition or crushing to achieve reduction of large asphalt chunks and blocks to relatively small particles of asphalt suitable for recycling and reconstitution preparatory to using it for paving and other purposes.

A further object of the invention is to provide an asphalt comminuting device which is mechanically rugged in its construction and can be used over extended periods of time with minimum necessity for repair or parts replacement.

Additional objects and advantages of the invention will become apparent as the following detailed description of the invention is read in conjunction with the accompanying drawings which illustrate a preferred embodiment of the invention.

DETAILED DESCRIPTION OF A PREFERRED EMBODIMENT OF THE INVENTION

Figure 1:
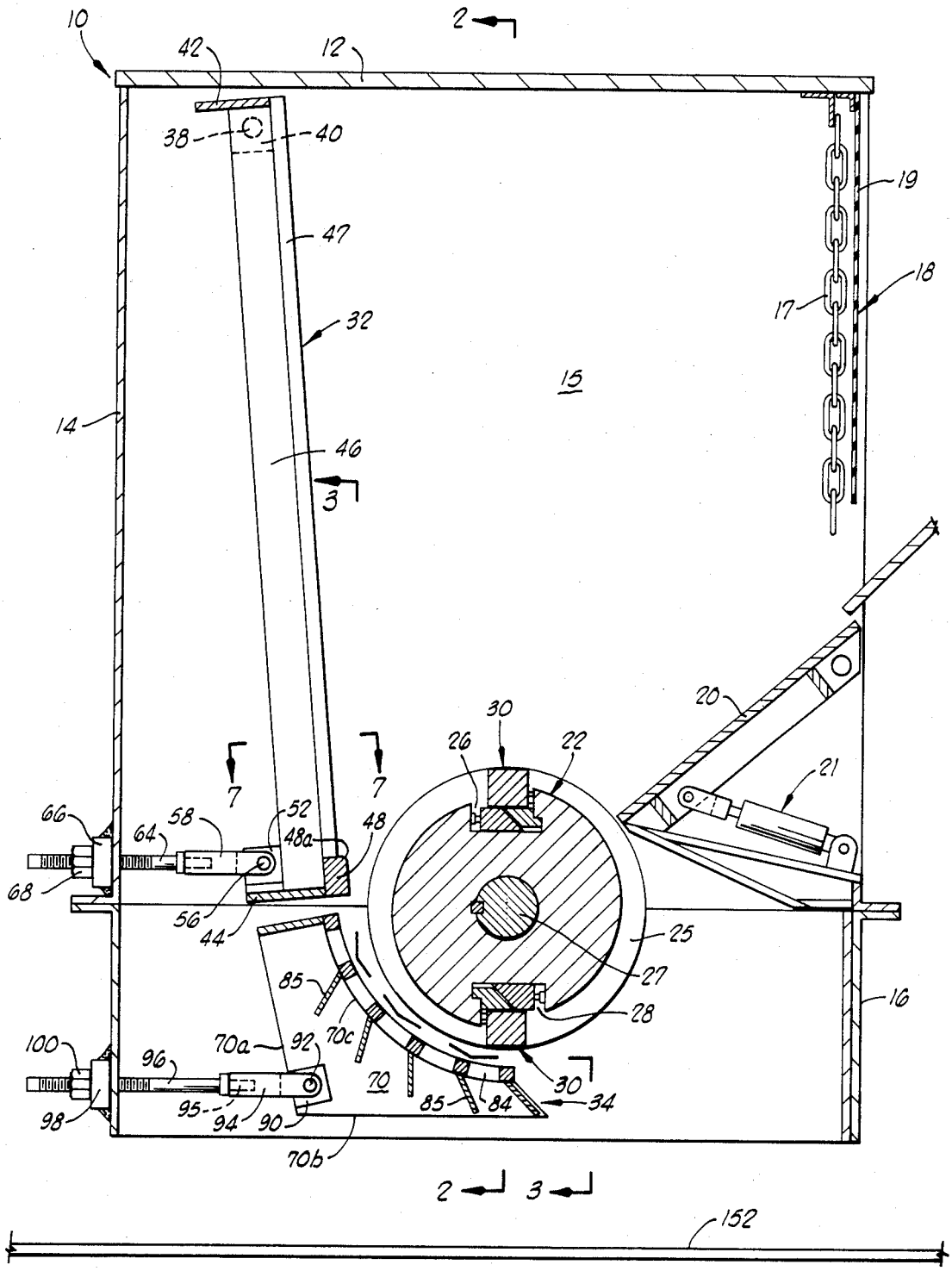
FIG. 1 is a vertical sectional view taken through the center of the asphalt comminuting apparatus of the invention.
Figure 2:
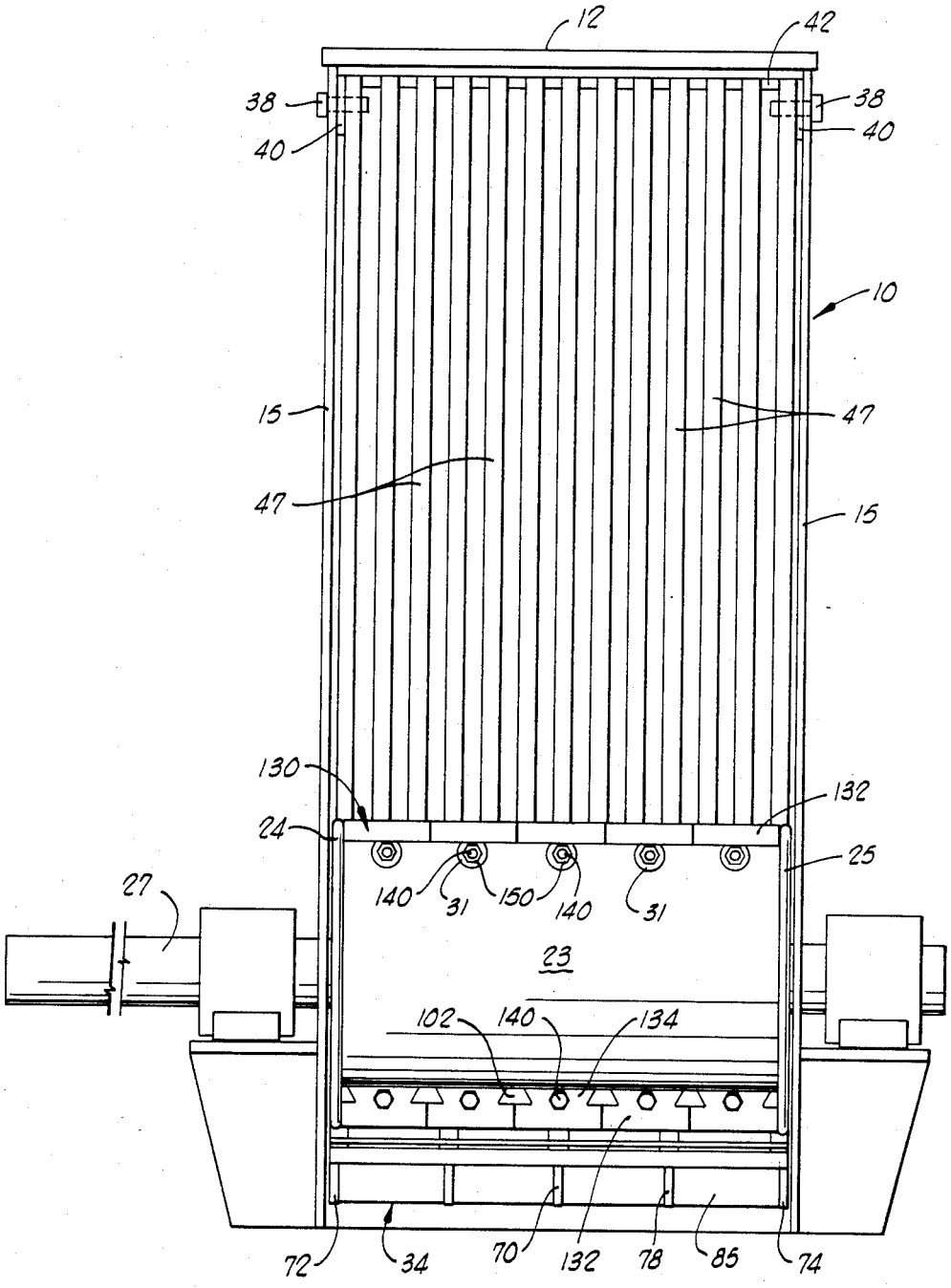
FIG. 2 is a sectional view taken along line 2—2 of FIG. 1.

Referring initially to FIG. 1, shown therein, in section, is a housing 10 which includes a top wall 12, a back wall 14 and side walls 15 (see FIG. 2). A partial front wall 16 extends upwardly from the bottom or lower side of the housing 10 and an access opening 18 is provided above the partial front wall 16 near the top of the housing. The opening 18 is closed by means of flexible closure flaps 19 and suspended chains 17. Typically, the opening can suitably be about thirty inches wide and about twenty-three inches high. At a location within the housing which is immediately beneath the access opening 18, an adjustable asphalt slide plate 20 is provided, and slopes downwardly and inwardly from the front side of the housing. A hydraulically powered mechanism 21 is provided for kicking the slide plate 20 upwardly. This action is occasionally employed to break loose an asphalt bridge which will sometimes form completely across the housing 10 at a location spaced upwardly from the drum 22.

An impact comminuting rotor or drum, designated generally by reference numeral 22, is centrally positioned and rotatably mounted in the lower portion of the housing 10. The drum 22 includes a central portion 23 having a pair of terminal flanges 24 and 25 at opposite ends thereof. The diameter of the central portion 23 of the drum 22 may typically be about twenty-four inches. A suitable power shaft 27 extends horizontally through the side walls 15 of the housing 10 and drivingly supports the drum 22 for rotation about a horizontal axis of rotation.

Figure 4:
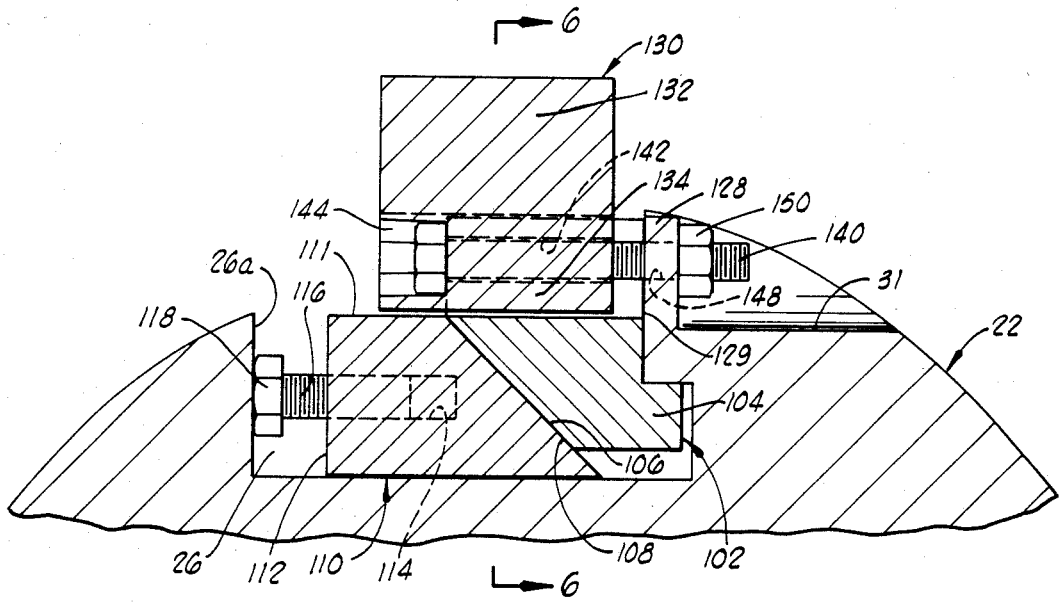
FIG. 4 is a sectional view taken in a diametric plane through the rotatable drum forming a part of the asphalt comminuting apparatus and illustrating, in section, a peripheral portion of the drum and one of the asphalt fracturing hammer assemblies secured to the drum at this peripheral location.

The drum 22 is shaped so that the outer peripheral surface of the drum is formed on two figures of revolution having offset centers of curvature. In other words, approximately 180° of the peripheral surface of the drum is formed as a semi-cylinder having its center of revolution at one point, and the other side of the drum includes about 180° of arc of peripheral surface which is formed as a semi-cylinder having its center of revolution offset from the center of revolution of the semi-cylinder at the opposite side of the drum. The result of this geometry is to form radial steps or offsets or breaks in the outer periphery of the drum at two locations. These two offsets or breaks are disposed approximately 180° from each other around the periphery of the drum, as is best shown in FIGS. 1 and 4.

At the location of the breaks or offsets which are provided on the periphery of the drum, a pair of undercut, radially inwardly extending axial slots 26 and 28 are formed in the drum periphery. Each of the axially extending slots 26 and 28 accommodates a hammer assembly 30 hereinafter described in greater detail. A plurality of small, chordally oriented recesses 31 are formed in the periphery of the drum at a location near the axial slots 26 and 28 and for a purpose herinafter described.

Positioned to one side of the drum 22 in the housing 10 are a pair of grate assemblies designated generally by reference numerals 32 and 34. The grate assembly 32, hereinafter termed the upper grate assembly, includes an elongated grate which has its upper end portion pivotally secured to the side walls 15 of the housing 10 by means of suitable pivotal pins 38. The pivot pins 38 extend into centrally apertured pivot plates 40 which are each welded or otherwise suitably secured along one edge to a top facing plate 42 located at the upper end of the upper grate assembly 32. A similar bottom facing plate 44 is located at the bottom of the grate assembly 32 and extends parallel to the plate 42.

Secured between the top plate 42 and the bottom plate 44 are a plurality of parallel screening plates 46. The screening plates 46 are faced with parallel, spaced screening bars 47. The screening plates 46 are of lesser width than the top plate 42 and bottom plate 44, and are spaced from each other by a spacing of about $1\frac{1}{4}$ inch. At the forward side of the lower end of the upper grate assembly 32, a heavy breaker bar 48 is secured transversely across the grate assembly 32 and faces toward the drum 22. The breaker bar 48 has a radiused or beveled upper inner side edge **48*a* as illustrated in FIG. 1**.

Figure 7:
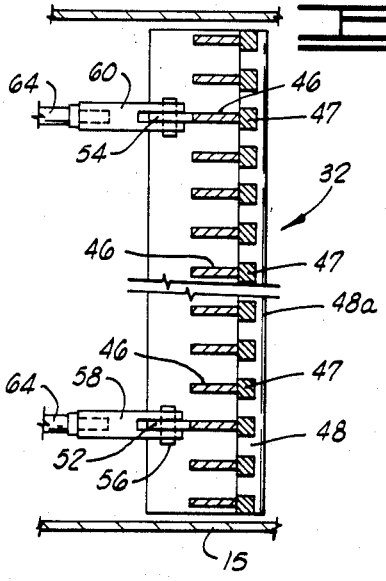
FIG. 7 is a sectional view taken along line 7—7 of FIG. 1.

Secured to the back side of the upper grate assembly 32, and at the lower end thereof are two spaced clevis plates 52 and 54. The clevis plates 52 and 54 are welded to spaced ones of the spaced parallel screening plates 46 located inwardly in the plate array as best illustrated in FIG. 7. The clevis plates 52 and 54 serve as anchor points for pivotally securing by suitable pivot pins 56, a pair of clevis brackets 58 and 60. Each of the clevis brackets 58 and 60 includes a bifurcated end which is pinned to one of the clevis plates 52 or 54, and also includes an internally bored end which receives the pin end of an adjusting shaft 64. Each adjusting shaft 64 has threads formed over a major portion of its length, and extends through the housing back wall 14 and through a reaction block 66 welded to the outer side of the back wall. An adjusting nut 68 is threaded on each of the adjusting shafts 64 and is secured to the respective reaction block 66. It will be perceived that by threading the adjusting shafts 64 into or out of the threaded adjusting nuts 68, the lower end of the upper grate assembly 32 can be swung toward the periphery of the drum 22 and the path of its peripherally carried hammer assemblies 30. The adjusting shafts 64 and nuts 68 also facilitate the retraction of the lower end of the upper grate assembly 32 to move the breaker bar 48 further from the rotating drum 22 and its associated hammer assemblies.

Figure 3:
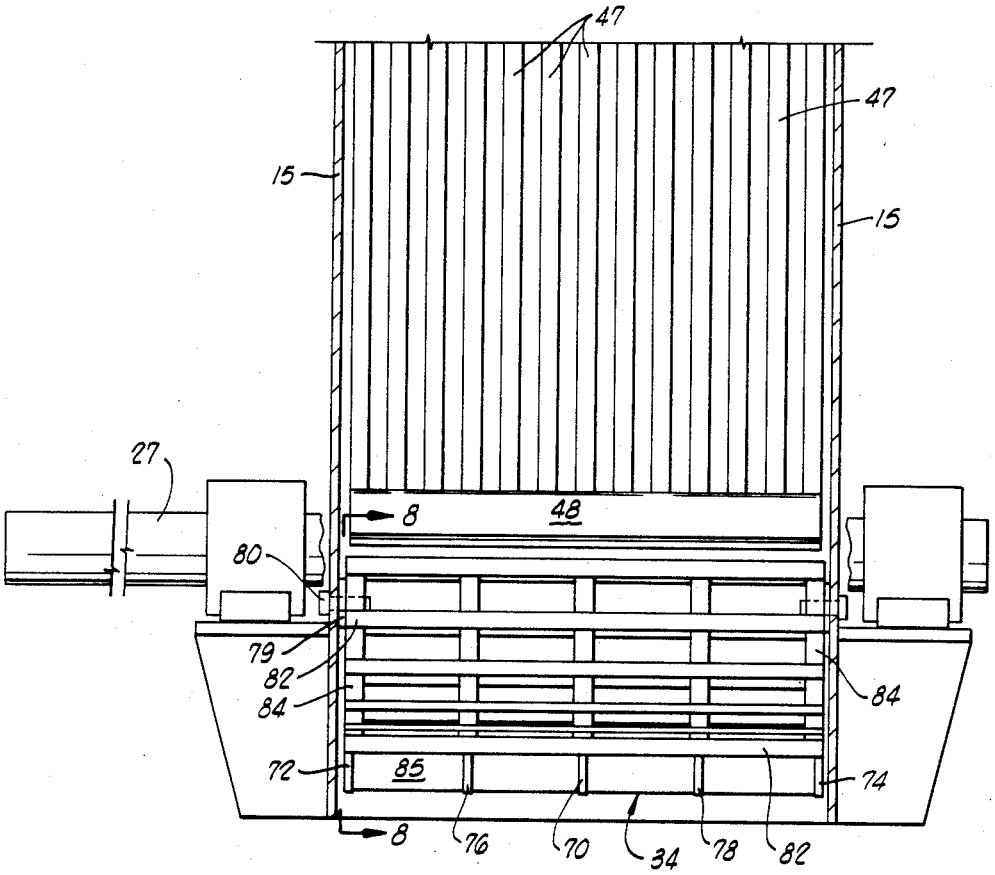
FIG. 3 is a sectional view taken along line 3—3 of FIG. 1.
Figure 8:
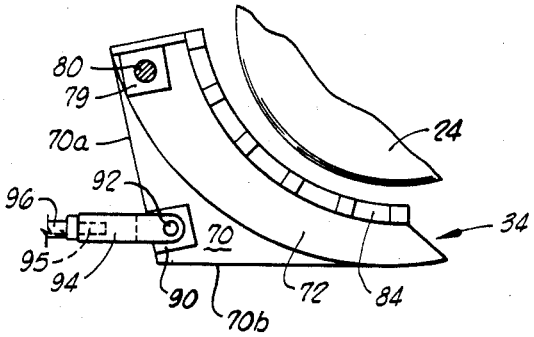
FIG. 8 is a sectional view taken along line 8—8 of FIG. 3.

The lower grate assembly 34 is pivotally mounted in the housing 10 immediately below the lower end of the upper grate assembly 32. The lower grate assembly 34 includes a relatively large central plate 70, a pair of end or terminal plates 72 and 74, and a pair of intermediate plates 76 and 78 as illustrated in FIGS. 1 and 3. The terminal plates 72 and 74 and the intermediate plates 76 and 78 are of substantially identical configuration, as shown in FIG. 8, and have an arcuate lower edge and an arcuate upper edge. Each one of a pair of centrally apertured pivot plates 79 is welded to the outer side of one of the terminal plates 72 and 74 and receives a pivot pin 80 used to pivotally support the lower grate assembly 34 in the housing for pivotation about a horizontal axis.

The central plate 70 includes a relatively straight back edge **70*a*, a relatively straight bottom edge 70*b* and an arcuate top edge 70*c*. The arcuate top edge 70*c*, like the arcuate top edges of the terminal and intermediate plates, is formed on an arc of a circle of slightly larger diameter than the diameter of the figure of revolution swept out by the hammer assemblies 30 carried on the drum 22. All of the plates 70–78 are interconnected along their upper edges by means of a plurality of spaced, transversely extending, substantially parallel breaker bars 82 located at the upper side of the lower grate assembly 34. Each of the breaker bars 82 has its lower edge welded to the several plates 70–78, and a series of spacer bars 84 are utilized for maintaining the spacing of the breaker bars 82 and for reinforcing them in their attachment to the plates 70–78. A series of horizontally spaced, generally downwardly directed particle deflecting plates 84 are secured to the lower sides of the breaker bars 82 and function to deflect broken asphalt particles downwardly. The deflecting plates 84 are in a fanned array and are thus oriented at varying angles to the vertical as shown in FIG. 1**.

At the rear lower side of the central plate 70, this plate has welded, or otherwise suitably secured thereto, a clevis pad or plate 90 and an aperture is formed through the clevis pad 90 and the central plate 70 to receive a pivot pin 92 used to pin a clevis bracket 94 to the lower grate assembly 34. The clevis bracket 94, constructed similarly to the clevis brackets 58 previously described, receives a pin 95 carried on one end of an elongated, externally threaded adjusting shaft 96. The adjusting shaft 96 extends through a reaction block 98 welded to the outside of the lower portion of the housing back wall 14. An adjusting nut 100 is threaded on the adjusting shaft 96, is secured to the reaction block 98, and is used for adjusting the position of the lower grate assembly 34 relative to the drum 22 in a manner hereinafter described.

Each of the hammer assemblies 30 mounted in the axially extending slots 26 and 28 includes an elongated hammer bar 102 which extends substantially from one end of the drum 22 to the other. Each elongated hammer bar 102 includes an upper or radially outer portion 103 and a lower or radially inner portion which carries a projecting toe 104. The toe 104 is dimensioned to extend into the undercut portion of the respective slot 26 or 28. On the opposite side of the lower portion of the hammer bar 102 from the toe 104, the hammer bar has an inclined or beveled surface 106. The surface 106 mates with a beveled or inclined face surface 108 carried at one side of each of one or more wedge blocks designated generally by reference numeral 110.

Each of the wedge blocks 110 is of trapezoidal cross-sectional configuration, as shown in FIG. 4, and includes an upper face 111 and a lateral face 112. The lateral face 112 extends parallel to a diametric plane of the drum 22. Each wedge block 110 also has a pair of spaced, internally threaded bores 114 formed into the wedge block from the lateral face 112. The bores 114 threadedly receive the externally threaded shank portions of a pair of bolts 116. Each of the bolts 116 carries a head 118. When the wedge blocks 110 are in use for wedgingly securing the hammer bars 102 in the axially extending slots 26 and 28 formed in the periphery of the drum 22, the heads 118 of the bolts 116 bear against one of the side walls **26*a* or 28*a* which define the respective axial slot 26 or 28. It will be noted in referring to FIG. 4 that the upper face 111 of each of the wedge blocks 110 lies in a plane which passes through the line along which the semi-cylindrical periphery of the drum 22 breaks radially inwardly to form one side wall of the respective slot 26 or 28 in the manner hereinbefore described, so that the surfaces 111** are not positioned interiorly of the slot, but are aligned even with the opening into the slot.

Figure 5:
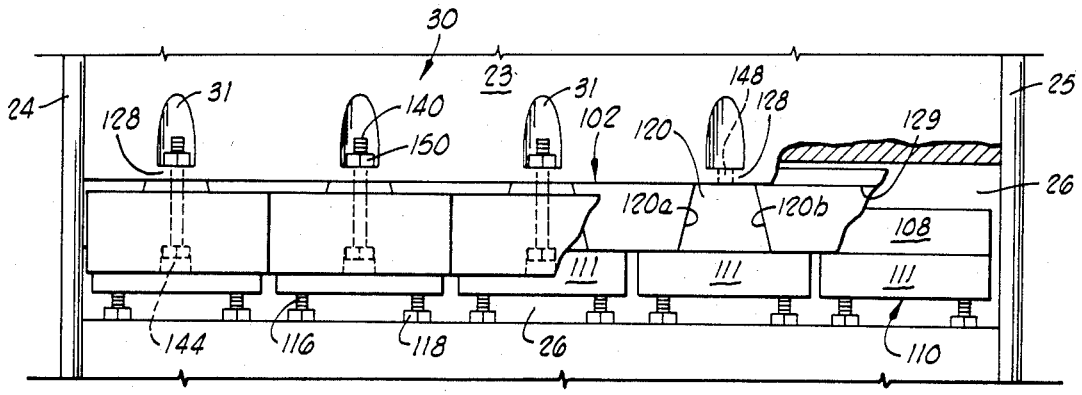
FIG. 5 is a top plan view, with certain parts broken away, of the peripheral portion of the drum shown in section in FIG. 4, and illustrating certain details of the hammer assembly and the manner in which it is mounted to the drum.
Figure 6:
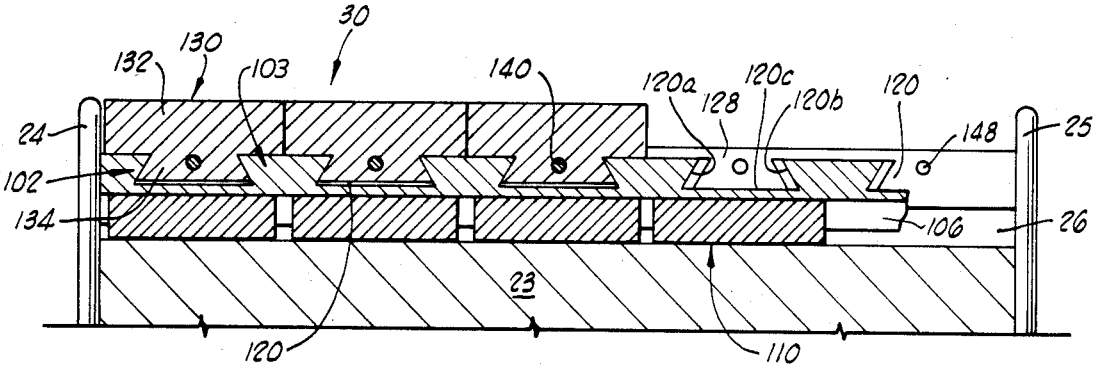
FIG. 6 is a sectional view taken along line 6—6 of FIG. 5.

The upper portion 103 of each of the elongated hammer bars 102 defines a plurality of spaced hammer-receiving slots 120 along the length of the respective hammer bar. These slots 120 are trapezoidally-shaped as viewed in plan and illustrated in FIG. 5. Each of the slots 120 thus includes a pair of opposing convergent sides **120*a* and 120*b*, also as shown in FIG. 5. Each of the slots 120 is also undercut with a dove-tailed undercut in the manner illustrated in FIG. 6 with such undercuts being defined by the inclination of the slot sides 120*a* and 120*b* as illustrated in FIG. 6. Thus, the bottom 120*c* of each of the hammer-receiving slots 120** is of greater width than the opening at the top (radially outer side) of the slot, and this undercut configuration aids in a manner hereinafter described in retention of the several hammer elements forming a part of the hammer assembly.

Located in alignment with each one of the hammer-receiving slots 120 is one of the chordal slots or recesses 31 previously described. Each chordal recess is formed in the periphery of the drum 22 and extends along a chord of the circular cross-sectional configuration of the drum. The several chordal slots 29, in addition to being aligned with the several hammer recesses 120, are located adjacent the axial slots 26 and 28 in which the hammer assemblies are received, and are separated from these axial slots by drum abutment portions 128 of the drum 22. One of the abutment portions 128 of the drum 22 is formed adjacent each of the slots 26 and 28, and is in contact with a facing surface 129 of the respective elongated hammer bar 102 located in the respective axial slot at a time when the hammer bars are locked in their operative position by means of the wedge blocks 110.

It will be noted in referring to FIGS. 1 and 4 that that peripheral portion of the drum 22 in which the chordal slots 126 are located is stepped radially outwardly from the peripheral portion of the drum which defines the sides **26*a* and 28*a* of the slots 26 and 28 against which the bolt heads 118 bear. As will be better understood from the following description, this particular geometric configuration and arrangement of parts facilitates the rapid detachment of individual hammer elements from the hammer bars 102 and quick replacement of such hammer elements when needed. Also facilitated by this construcion is the rapid removal of the hammer bars 102 and wedge blocks 110** for repair or replacement in the event of excessive wear or deterioration of these elements with extended use of the comminuting apparatus.

A plurality of hammers 130 are detachably mounted to each of the elongated hammer bars 102 in axial alignment therealong. The axial dimension of the hammers 130 is such that they abut each other and form an uninterrupted axial line along the drum 22. Each of the hammers 130 includes a radially outer or upper portion 132, which is shaped as a right parallelepiped, and a radially inner root portion 134 formed integrally with the upper portion and disposed centrally beneath the upper portion. The root portion 134 is trapezoidally-shaped or dove-tailed in transverse cross-section, as shown in FIG. 6, so as to mate with one of the undercut hammer-receiving slots 120 in the upper portions of the hammer bars 102. The root portions 134 of the hammers 130 are each trapezoidally shaped in a plane which extends along a chord of the drum 22 so that the root portion will slide into the slots 120 in the hammer bars 102. Each of the root portions 134 is dimensioned so that the narrow end of the root portion can be initially inserted into the wide end of a hammer-receiving slot 120 in the hammer bar 102, and the hammer 130 then pushed into the slot until the opposed convergent sides of the root portion engage the convergent sides **120*a* and 120*b* of the respective slot 120. Thus, and in summary, the root portion 134 of each hammer 130 is configured so that the root portion mates with and interlocks with the undercut of a slot 120 in the hammer bar 102 into which the hammer is set, and the hammer is also locked against circumferential movement in one direction on the drum 30 by reason of its root portion being of a width such that it becomes wedged in the slot as it is moved in a circumferential direction on the drum 22**.

The hammers 130 are further locked in their operating positions within the undercut grooves 120 by means of elongated locking bolts 140. Thus, each of the hammers 130 includes a bolt bore or passageway 142 which extends through the hammer at a location which is approximately at the junction of the root portion 134 with the upper portion 132 of the hammer. Each bolt bore 142 and the shank of the bolt received therein extends substantially normal to a radius of the drum 22 which extends through the respective hammer 130 and the hammer-receiving slot 120 in which it is located. Each bolt passageway 142 communicates with a relatively large bolt head opening 144 in the hammer 130 so that the bolts 140 can be countersunk in the hammers when they are used to lock the hammers in their operative positions. Each of the locking bolts 140 carries an externally threaded shank which projects through the respective bolt passageway 142 and through a bolt aperture 148 formed through the adjacent abutment portion 128 carried on the periphery of the drum 22. A locking nut 150 is engaged with the threads of each bolt 140, and each bolt is placed in tension by threading its locking nut 150 against the respective abutment portion 128.

It will be noted in referring to FIG. 4 that the position of each locking bolt 140 and its respective locking nut 150 within its respective chordal slot or recess 31 is such that both the protruding bolt shank and the locking nut are laterally protected by the opposite sides of the respective chordal recess in which they are located. It will further be noted in referring to FIG. 4 that the bottom side 120*c* of each of the slots 120 is in substantially coplanar alignment with the upper face 111 of the wedge blocks 110 at a time when the wedge blocks are used for wedging the hammer bar 120 into interlocked engagement with the undercut in its respective receiving axial recess 26 or 28.

OPERATION

In utilizing the asphalt comminuting apparatus of the invention for breaking up large chunks and slabs of asphalt as they are brought to the apparatus after being removed from an old roadway, or other source, the asphalt is dumped through the access opening 18 into the housing 10 so that it slides down the slide plate 20. As the asphalt slides down the slide plate 20, it passes into the path of the hammer assemblies 30 carried on the periphery of the rapidly rotating drum 22. It will be noted that as the drum 22 is rotated in a counterclockwise direction as it is viewed in FIG. 1, the relatively large surface area side of the hammers 130 is the leading side and initially comes into contact with the asphalt chunks or slabs. The hammers 130, in impacting the asphalt, break off parts of the asphalt and propel them upwardly in the housing 10, and in the general direction of the upper grate assembly 32.

Relatively small particles of asphalt which are broken away from the chunks and slabs by impact with the hammers 130 are able to pass between the screening plates 46 of the upper grate assembly 32 and fall downwardly to the bottom of the housing and through an opening (schematically illustrated) onto a suitable conveyor assembly which is schematically illustrated in FIG. 1, and is designated generally numeral 152. Some larger fragments of asphalt will strike the screening bars 47 and the impact of these fragments against the screening bars will achieve a further subdivision or fractionation of the particles so that some of the resulting particles can pass through the screening plates 46 as they fall downwardly.

The fragments which are too large to pass between the screening plates 46 of the upper grate assembly 32 will fall downwardly into the throat or nip formed between the lower end of the upper grate assembly 32 and the periphery of the drum 22 and rotational path of the hammer assemblies 30 carried at the periphery thereof. As these fragments of the asphalt enter the nip or constricted space between the heavy breaker bar 48 and the periphery of the drum 22, they are impacted by one or more of the hammers 130 as the drum continues to rapidly rotate. Slabs of asphalt which may lie across the heavy breaker bar 48 in a transverse direction are sheared by the edges of the hammers 130 which pass adjacent the face of the breaker bar 48.

The inclination of the upper grate assembly 32 to the vertical is adjusted by means of the adjusting shafts 64 and adjusting nuts 68. Thus, the size of the nip between the lower portion of the grate assembly 32 and the rotational path of the hammers 130 can be varied as may be desirable to more efficiently comminute various types of asphalt. I have found that, in general, positioning the upper grate assembly so that its plane extends at an angle of about 17° to a tangent to the rotational path of the tips of the hammers 130 will achieve very effective crushing of most asphalt feedstocks. The tangent to which reference is here made is that tangent which includes a point lying in a horizontal line drawn from the closest point on the breaker bar 48 to the rotational path of the hammer tips.

When the asphalt has been subdivided sufficiently by this impact to fall downwardly through the described nip or constricted space, it passes onto the lower grate assembly 34. As the now relatively small particles which have passed through the nip between the breaker bar 48 and the drum and its hammers moves down into the space between the lower grate assembly 34 and the drum 22, the gradually diminishing cross-sectional dimension of the space between the lower grate assembly and the drum causes crushing and grinding of the asphalt at this location. There is thus a progressive attrition of particles as the hammer assemblies 30 continue to sweep past the lower grate assembly 34, thereby grinding the asphalt particles against the transversely extending breaker bars 82. The particles are thus reduced to a size such that many of them can pass between the breaker bars 82 and can be guided downwardly by the particle-directing plates 85. Thus, these particles fall upon the conveyor 152 and are carried away to a reconstituting plant where they can be reconstituted into new asphalt.

In some instances, to achieve more efficient operation, or to acheive a grind which is either coarser or finer, it will be desirable to adjust the position of not only the upper grate assembly 32, but also the lower grate assembly 34 in relation to the drum 22. This is accomplished by means of the adjusting shaft 96 and adjusting nut 100 which are provided. Thus, if it should be desired to grind and subdivide the asphalt to a finer state, the adjusting shaft 64 will be turned in a direction so that it is advanced and the breaker bar 48 carried on the lower end of the upper grate assembly 32 is moved to a position closer to the drum 22 and rotating hammer assemblies 30, and it may also be desirable, in achieving greater subdivision and finer particles in the final product, to adjust the lower grate assembly 34 toward the drum by rotating the adjusting shaft 96 so that the adjusting shaft 96 is advanced inwardly through the nut 100 and into the housing. This causes the lower grate assembly 34 to pivot about the pivot pins 80 by which it is mounted in the housing, and thus causes the lower central end of the lower grate assembly to move inwardly and upwardly toward the drum 22. It will be perceived that this movement causes a diminution of the transverse dimension of the nip which is formed between the lower grate assembly 34 and the rotating hammer assemblies 30 carried on the drum 22. Thus, a greater compaction and greater grinding of the asphalt which has fallen into the space between the rotating drum hammer assemblies and the lower grate assembly 34 will be accomplished.

It will, of course, be apparent that if the particle size is to be made larger, the adjusting shafts are oppositely manipulated so as to retract the adjusting shaft and therefore move the lower end of the upper grate assembly 32 and/or the lower inner end of the lower grate assembly 34 in a direction away from the drum 22.

An important aspect of the present invention is the manner in which the hammer assemblies 30 are constructed and utilized. By using, in each hammer assembly 30, a plurality of axially aligned hammers 130 which are abutted against each other so as to effectively operate as a single hammer extending the length of the drum, an uninterrupted impact face is provided at the leading side of these hammers, and extends from one end of the drum to the other. Yet, each of the several hammers 130 is individually removable from the hammer bar 102 upon which it is mounted. Such removal and replacement can be accomplished at any time and quite easily without the necessity to remove any other part of the hammer assembly 30. This is accomplished by merely rotating the locking nut 150 until it is removed from the threaded shaft of the elongated locking bolt 140. The locking bolt 140 can then be pushed toward the left, as it is viewed in FIG. 4, and the respective hammer 130 which is being removed can be easily unseated from its particular hammer-receiving slot 120 of the hammer bar 102. Replacement of the hammer 130 on the hammer bar 102 is accomplished in the opposite fashion, with the small end of the root portion 134 of the hammer inserted into the large end of the trapizoidally-shaped hammer-receiving slot first, and the hammer then pushed all the way home in the slot. The locking bolt 140 is then extended through the bolt bore 142 and through the aperture 148 in the drum abutment portion 128. Finally, the locking nut 150 is screwed up tightly to retain the hammer 130 in its locked, operative position.

With this construction, it will be perceived that the impact forces which are brought to bear on the hammer 130 as it strikes asphalt chunks and slabs tends to drive the hammer more firmly into its hammer-receiving slot 120. Moreover, this impact force is distributed primarily to the hammer bar upon which it is mounted, as opposed to the elongated locking bolt 140 which retains it in its respective hammer-receiving slot 120 in the hammer bar. The locking bolt 140 merely assures that the root portion 134 of the hammer is snugged up tightly into the hammer-receiving slot. Further, the head of the elongated locking bolt 140 is protected from direct impact by being countersunk within the bolt head opening 144 formed in the root portion 134 of the hammer 130, and the threaded shank and locking nut 150 are protected by being on the trailing side of the hammer and thereby shielded by the hammer itself as the drum and its hammer assemblies are rotated in a counterclockwise direction as viewed in FIG. 1 of the drawings. Finally, in being located in one of the chordal slots 31, both the end of the threaded shank of the bolt 140 and the locking nut 150 are somewhat protected from damaging impact by asphalt chunks or particles.

On some occasions, it may be desirable to replace one or more of the hammer bars 102. This also is easily accomplished with the hammer assembly 30 used in the present invention. When it is desired to replace one of the hammer bars 102, the bolts 116 are threaded into the internally threaded bores 114 formed in one side of the wedge blocks 110. When the bolts 116 have been threaded far enough into the internally threaded bores 114, wedge blocks 110 can move to the left as viewed in FIG. 4. If the hammers 130 carried on the hammer bar 102 have been removed, the wedge blocks and the hammer bar 102 can then be removed if desired, or even if it is desired to leave the wedge blocks 110 in their respective axial slots 26 or 28, the hammer bar 102 can be lifted out and completely replaced.

By making the upper face 111 of the wedge blocks 110 substantially coplanar with the bottom 120*c* of the several hammer-receiving slots 120, the root portions 134 of the hammers 130 can be slid quickly and easily into their hammer-receiving trapezoidally-shaped, undercut slots 120 in the hammer bar without any interference being afforded by the wedge blocks. Moreover, the projecting, exposed extent of the upper surface 111 of the several wedge blocks 110 aids in aligning the hammers with their receiving slots in the hammer bars 102 so that the heavy hammers are relatively easily lined up and forced home in their receiving slots by resting the bottom surface of the lead portions 134 of the several hammers on the upper surface 111 of the wedge blocks 110.

Although a preferred embodiment of the invention has been herein illustrated and described, it will be understood that various changes and innovations can be made in the described and illustrated structure without departure from the basic principles which underlie the invention. Changes and innovations of this type are therefore deemed to be circumscribed by the spirit and scope of the invention except as the same may be necessarily limited by the appended claims or reasonable equivalents thereof.

What is claimed is:

1. Solids comminuting apparatus comprising:

a housing;

a drum mounted in said housing for rotation about a horizontal axis, said drum having at least two axially extending slots in the periphery thereof, said slots spaced circumferentially around the drum from each other;

a hammer assembly mounted in each of said axially extending slots, each of said hammer assemblies comprising;

an elongated hammer bar mounted in the respective axially extending slot and including:

a radially inner portion having a tapered side extending substantially parallel to the axis of rotation of said drum; and a radially outer portion having a plurality of spaced, trapezoidally-shaped, undercut, dovetailed, hammer-receiving slots formed therein and spaced longitudinally from each other over the length of the hammer bar;

at least one wedge bar of trapezoidal cross-section positioned in the respective axially extending slot adjacent said hammer bar and including a tapered face bearing against and mating with the tapered side of the radially inner portion of said hammer bar;

means adjustably positioned between said wedge bar and a side of the respective axially extending slot in the periphery of said drum bearing against a radially extending side of the respective axially extending slot for forcing said wedge bar and said hammer bar toward the opposite side of said axially extending slot;

a plurality of axially aligned hammers datachably mounted on said hammer bar, each of said hammers including:

a radially inner trapezoidally-shaped root portion wedged into one of said dove-tailed hammer-receiving slots; and a radially outer impact and grinding portion;

means detachably locking each individual one of said hammers in its respective hammer-receiving slot on said hammer bar whereby each of said hammers can be individually removed from, and replaced on, said hammer bar, said means detachably locking said hammers comprising:

a hammer locking bolt extending through the respective hammer and a peripheral portion of said drum in a direction substantially normal to a radius of the drum extended through the respective axially extending slot of the respective hammer bar; and a locking nut threaded on said hammer locking bolt;

means in said housing for feeding a material to be comminuted into the path of said hammers as said drum and its peripherally mounted hammer assemblies are rotated;

an upper grate assembly pivotally mounted in said housing and having a movable lower end portion, and a plurality of generally vertically extending screening plates;

adjusting means extending into said housing from the outer side thereof and having an inner end connected to the movable lower end portion of said upper grate assembly for moving the lower end portion of said upper grate assembly toward and away from said drum; and a lower grate assembly of arcuate configuration pivotally mounted in said housing below said upper grate assembly and adjacent a lower portion of said drum, said lower grate assembly including:

an upper end portion pivotally supported in said housing for pivotation about a horizontal axis;

a lower end portion;

a plurality of parallel spaced plates extending from the upper end portion of the lower grate assembly to the lower end portion of the lower grate assembly and each lying in a plane extending substantially normal to the axis of rotation of the drum; and a plurality of spaced, parallel transverse breaker bars extending across and interconnecting said plates and extending parallel to the axis of rotation of said drum; and means for adjustably moving the lower end portion of said lower grate assembly toward and away from said drum.

2. Solids comminuting apparatus as defined in claim 1 wherein said means adjustably positioned between said wedge bar and a side of the respective axially extending slot comprises at least one bolt extending between said wedge bar and said radially extending side of the respective axially extending slot and threadedly connected to one of said wedge bar and said drum for extension upon rotation of the bolt in a direction to force the wedge bar toward the hammer bar.

3. Solids comminuting apparatus as defined in claim 1 wherein said means detachably locking said hammers comprises:

a hammer locking bolt extending through the respective hammer and a peripheral portion of said drum in a direction substantially normal to a radius of the drum extended through the respective axially extending slot in the respective hammer; and a locking nut threaded on said hammer locking bolt.

4. Solids comminuting apparatus as defined in claim 1 wherein said means in said housing for feeding material comprises a slide plate for gravitating material to be comminuted into the path of said hammers from an opening in the side of the housing.

5. Solids comminuting apparatus as defined in claim 4 and further characterized as including means for pivoting said slide plate upwardly to impact and break loose asphalt bridging across said housing.

6. Solids comminuting apparatus as defined in claim 1 wherein each of said axially extending slots in the periphery of the drum is undercut; and wherein each of said hammer bars includes a toe portion projecting from said radially inner portion into the undercut of the respective axially extending slot in which the hammer bar is located.

7. Solids comminuting apparatus as defined in claim 6 wherein said means adjustably positioned between said wedge bar and a side of the respective axially extending slot comprises at least one bolt extending between said wedge bar and said radially extending side of the respective axially extending slot and threadedly connected to one of said wedge bar and said drum for extension upon rotation of the bolt in a direction to force the wedge bar toward the hammer bar.

8. Solids comminuting apparatus as defined in claim 1 wherein each of wedge bars includes a radially outwardly facing face, and wherein each of said hammer-receiving slots includes a radially inner bottom surface which is in substantially coplanar alignment with said radially outwardly facing face.

9. Solids comminuting apparatus as defined in claim 1 wherein said drum is further characterized as defining a plurality of chordally oriented axially spaced recesses in the periphery thereof, with an axial line of said recesses being located adjacent each of said axially extending slots, and said drum having an abutment portion separating each of said chordally oriented recesses from the adjacent one of said axially extending slots constituting the peripheral portion of said drum through which one of said hammer locking bolts extends.

10. Solids comminuting apparatus as defined in claim 1 wherein each of the spaced plates in said lower grate assembly is characterized in having an arcuate upper edge, and wherein the arcuate upper edges of said spaced plates are aligned along the periphery of a figure of revolution which has an axis of revolution extending coincident with, or parallel to, the axis of revolution of said drum.

11. Solids comminuting apparatus as defined in claim 1 wherein said adjusting means for moving the lower end of the upper grate assembly comprises:

a pair of spaced adjusting shafts each having an end connected to one of said screening plates; and a threaded portion extending through a wall of the housing; and an adjusting nut threadedly surrounding each of said adjusting shafts and secured to the exterior of said housing, whereby rotation of said adjusting shafts in one direction extends them further into said housing, and rotation of said adjusting shafts in the opposite direction retracts them so that they move toward the outside of the housing.

12. Solids comminuting apparatus as defined in claim 1 wherein said means in said housing for feeding material comprises a slide plate for gravitating material to be comminuted into the path of said hammers from an opening in the side of the housing.

13. A rotary drum assembly for reducing large solids by impact comprising:

a generally cylindrical drum having at least two circumferentially spaced, radially inwardly extending axial slots in the periphery of the drum and extending over a major portion of the length thereof;

means supporting the drum for rotation about its longitudinal axis;

hammer assemblies detachably mounted in each of said axial slots and each including:

an elongated hammer bar extending along the respective slot and having;

a radially inner portion within the respective axial slot in the periphery of the drum, and having a beveled side extending at an acute angle to a radius of the drum and projecting parallel to the axis of rotation of the drum; and a radially outer portion defining a plurality of spaced, undercut hammer-receiving slots spaced from each other along the length thereof, each of said hammer-receiving slots having an opening of trapezoidal-shape at the radially outermost surface of the hammer bar, and having a hammer entrance opening at one side of the radially outer portion of the hammer bar and spaced radially outwardly from said beveled side of the radially inner portion of the hammer bar, and each of said hammer-receiving slots further having a third opening on the opposite side of said outer portion from said hammer entrance opening, said third opening being of smaller area than said hammer entrance opening to facilitate wedging of a hammer in the respectve hammer-receiving slot, each of said hammer-receiving slots being of dove-tailed, undercut, cross-sectional configuration in radial planes extending through the hammer-receiving slot;

at least one wedge bar in each of said axial slots in the periphery of said drum, said wedge bar having a beveled face bearing against and mating with the beveled side of the radially inner portion of said hammer bar for wedging said hammer bar toward one side of the respective axial slot in which the wedge bar and hammer bar are located, said wedge bar further including a radially outwardly facing face intersecting its tapered face and disposed in substantially coplanar alignment with the bottom of at least one of said hammer-receiving slots in the radially outer portion of said hammer bar;

bolts extending between one side of each of the axial slots and the wedge bars located therein and cooperating with the respective wedge bars upon rotation of the bolts to move the wedge blocks toward the hammer bar and thereby lock the hammer bar in the axial slot in which it is located;

a hammer detachably located in each of the hammer-receiving slots in each of said hammer bars, each of said hammers having:

a trapezoidally-shaped, dove-tailed, radially inner root portion dimensioned to fit into, and mate with, its respective hammer-receiving slot in said hammer bar; and a radially outer grinding and impact portion; and each of said hammers defining a bolt bore extending therethrough from one side of the hammer to the other side of the hammer in a direction extending substantially normal to a radius of the drum extending through the respective hammer and the respective hammer-receiving slot in which the hammer is detachably mounted;

bolt-engaging means on the periphery of the drum adjacent each of said hammer-receiving slots in said hammer bar; and hammer-locking bolt means extending through the bolt bore of each of said hammers and through said bolt-engaging means and detachably locking each of said hammers in its respective hammer-receiving slot in said hammer bar.

14. A rotary drum assembly for reducing large solids as defined in claim 13 wherein each of said axial slots is undercut into the drum on the opposite side of the respective axial slot from said one side thereof; and wherein each of said hammer bars further includes a toe portion projecting into said undercut of the respective axial slot from the opposite side of the radially inner portion of said hammer bar from that constituting the beveled side thereof.

15. A rotary drum assembly for reducing large solids as defined in claim 14 wherein said wedge blocks define internally threaded, spaced bolt holes, and wherein each of said bolts has a threaded shank portion threaded into one of said internally threaded holes, and a head facing said one side of the respective axial slot.

16. A rotary drum assembly for reducing large solids as defined in claim 13 wherein the radially outer impact portion of each of said hammers is of rectangular cross-section, and wherein the hammers detachably located in the hammer-receiving slots on each of said hammer bars abut each other to form an uninterrupted axial line of hammers.

17. A rotary drum assembly for reducing large solids as defined in claim 16 wherein said bolt engaging means comprises:

an abutment portion formed integrally with the drum; and a chordal slot formed in the drum adjacent said abutment portion.

18. A rotary drum assembly for reducing large solids as defined in claim 13 wherein said bolt engaging means comprises:

an abutment portion formed integrally with the drum; and a chordal slot formed in the drum adjacent said abutment portion.

19. A rotary drum assembly for reducing large solids as defined in claim 18 wherein said hammer-locking bolt means comprises:

a bolt having a threaded shank extending through said bolt bore, through said abutment portion, and into said chordal slot; and a locking nut threaded on said threaded shank and located in said chordal slot.

20. A rotary drum assembly for reducing large solids as defined in claim 19 wherein said drum has a pair of radially offset peripheral portions disposed on opposite sides of two of said radially inwardly extending axial slots, said radially offset periphral portions each being semi-cylindrical in configuration and formed about offset axes of curvature, said offset peripheral portions defining radial steps in the periphery of the drum, and said hammers each having an impact face facing the low open side of one of the radial steps and located on the opposite side of the respective hammers from said bolt-engaging means.

21. A rotary drum assembly for reducing large solids as defined in claim 20 wherein each of said axial slots is undercut into the drum on the opposite side of the respective axial slot from said one side thereof; and wherein each of said hammer bars further includes a toe portion projecting into said undercut of the respective axial slot from the opposite side of the radially inner portion of said hammer bar from that constituting the beveled side thereof.

22. A rotary drum assembly for reducing large solids as defined in claim 13 wherein each of said wedge blocks defines an internally threaded, spaced bolt hole, and wherein each of said bolts has a threaded shank portion threaded into one of said internally threaded holes, and a head facing said one side of the respective axial slot.

23. A rotary drum assembly for reducing large solids as defined in claim 13 wherein said drum has a pair of radially offset peripheral portions disposed on opposite sides of two of said radially inwardly extending axial slots, said radially offset peripheral portions each being semi-cylindrical in configuration and formed about offset axes of curvature, said offset peripheral portions defining radial steps in the periphery of the drum, and said hammers each having an impact face facing the low open side of one of the radial steps and located on the opposite side of the respective hammers from said bolt-engaging means.

24. In a rotary drum impacting comminuting apparatus of the type which includes a cylindrical drum within a housing into which material to be reduced in size is fed, which drum carries a plurality of axially extending, undercut circumferentially spaced slots in the periphery of said drum, the improvement which comprises:

a hammer assembly set into each of the said axially extending undercut circumferentially spaced slots in the periphery of the drum and including portions projecting radially outwardly from the periphery of the drum, said hammer assemblies each including:

hammer bar means in each of said axially extending slots, each of said hammer bar means having an upper, radially outer portion defining at least one upwardly opening undercut slot, and having a lower, radially inner portion, said radially inner portion having a beveled side surface extending parallel to the rotational axis of the drum; and a toe portion on the opposite side of the radially inner portion from said beveled side surface and extending into the undercut of the axially extending slot in which said hammer bar means is located;

a hammer associated with each of said slots on said hammer bar and having an upper, radially outer portion of right parallelpiped configuration; and a root portion in one of said slots and of complementary configuration to said one slot;

means detachably retaining said hammer root portion in said one slot;

a wedge bar having a beveled face bearing against and mating with the beveled side surface of the radially inner portion of said hammer bar means;

a second face extending parallel to a diametric plane of the drum; and a radially outwardly facing face extending normal to said second face and intersecting said beveled face; and at least one bolt threaded into a bore in said second face, and having a head positioned to abut a side of the axially extending slot in which the respective hammer assembly is located when said bolt is rotated in a direction to back it out of said bore.

* * * * *